US006002906A

United States Patent [19]

Hino et al.

[11] Patent Number: 6,002,906

[45] Date of Patent: Dec. 14, 1999

[54] IMAGE FORMING APPARATUS WHICH CONTROLS THE IMAGE FORMING OPERATION ON THE BASIS OF THE RECORDING SHEET

[75] Inventors: Hideki Hino, Toyokawa; Yoshiaki Takano, Toyohashi; Kazuo Okunishi, Okazaki; Kentaro Nagatani, Toyohashi, all of Japan

[73] Assignee: Minolta Co., Ltd., Osaka, Japan

[21] Appl. No.: 09/196,235

[22] Filed: Nov. 20, 1998

[30] Foreign Application Priority Data

Nov. 21, 1997 [JP] Japan ..... 9-321792

[51] Int. Cl.[6] ..... G03G 15/00

[52] U.S. Cl. ..... 399/303; 399/45; 399/81

[58] Field of Search ..... 399/45, 303, 312, 399/81

[56] References Cited

U.S. PATENT DOCUMENTS 5,867,759 2/1999 Isobe et al. ..... 399/303 X

FOREIGN PATENT DOCUMENTS 05002347 8/1993 Japan .
6-35262 2/1994 Japan .

*Primary Examiner*—Susan S.Y. Lee
*Attorney, Agent, or Firm*—McDermott, Will & Emery

[57] ABSTRACT

An image forming apparatus includes a recording sheet transporting member which has an inappropriate portion not suitable for forming an image and which transports a recording sheet while holding the recording sheet thereon, the recording sheet transporting member being endless, and a recording sheet feeding member which feeds the recording sheet to the recording sheet transporting member. The image forming apparatus further includes a controller. The controller controls at least one of the recording sheet transporting member and the recording sheet feeding member in accordance with data regarding a characteristic of the recording sheet so that the recording sheet is fed to the recording sheet transporting member so as not to be located on the inappropriate portion in a case where the image forming apparatus is in a first mode, and so that the recording sheet is fed to the recording sheet transporting member regardless of the inappropriate portion in a case where the image forming apparatus is in a second mode.

20 Claims, 10 Drawing Sheets

RECORDING SHEET SIZE INFORMATION

| |
|---|
| Tp |

FIG.11

RECORDING SHEET TYPE INFORMATION

| |
|---|
| |

FIG.12

SETTING INFORMATION

| |
|---|
| $\alpha$ |
| $\beta$ |
| $\gamma$ |
| Ts |

FIG.13

FORMULA INFORMATION

| |
|---|
| RIGHT-HAND SIDE |

FIG.14

IMAGE FORMING APPARATUS WHICH CONTROLS THE IMAGE FORMING OPERATION ON THE BASIS OF THE RECORDING SHEET

BACKGROUND OF THE INVENTION

1. Field of the Invention

The present invention relates to an image forming apparatus, for example, an electrophotography type, an electrostatic recording type image forming apparatus, or the like, and more particularly, to a color image forming apparatus such as a color copying machine, a color printer, or a similar apparatus, wherein a plurality of image forming members are provided to form a plurality of images, each different in color, on respective image storing members, and then these images are transferred, one on another, in turn, on the same recording sheet, held and transported by a recording sheet transporting member.

2. Description of the Related Art

In an image forming apparatus which includes an endless transporting belt having a seam and which transfers an image to a recording sheet held on the transporting belt from a photosensitive drum, if image transferring is performed when the recording sheet is located on the seam, a portion of the image may not be transferred on the recording sheet, resulting in a poor image.

In order to solve the problem, there has been proposed an image forming apparatus (for example, Japanese Unexamined Laid-open Patent Publication No. H5(1993)-2347) with a seam detector provided to detect the seam of the transporting belt. Based on the seam position detected by the seam detector and the size of the recording sheet, the feeding of the recording sheet to the transporting belt is controlled so that the recording sheet is not located on the seam.

However, in the above-mentioned conventional image forming apparatus, the recording sheet is always fed so as not to be located on the seam regardless of the type of the recording sheet. Accordingly, even relatively thick recording sheets such as an OHP film or a cardboard, which are seldom affected by the seam, are always fed on the transporting belt so as to always avoid the seam, which results in a decreased productivity for the whole apparatus.

SUMMARY OF THE INVENTION

It is an object of the present invention to provide an image forming apparatus having an improved efficiency of the feeding of a recording sheet to a recording sheet transporting member.

It is another object of the present invention to provide an image forming apparatus having an improved productivity for the whole apparatus.

According to one aspect of the present invention, an image forming apparatus includes a recording sheet transporting member which has a specific portion and transports a recording sheet while holding the recording sheet thereon, the recording sheet transporting member being endless, a recording sheet feeding member which feeds the recording sheet to the recording sheet transporting member, and a controller which controls at least one of the recording sheet transporting member and the recording sheet feeding member so that the recording sheet is fed to the recording sheet transporting member so as not to be located on the specific portion in a case where the image forming apparatus is in a first mode, and so that the recording sheet is fed to the recording sheet transporting member regardless of the specific portion in a case where the image forming apparatus is in a second mode. The controller selectively sets the image forming apparatus in the first mode or in the second mode in accordance with data regarding a characteristic of the recording sheet such as a length of the recording sheet, a thickness of the recording and a type of the recording sheet.

In the image forming apparatus, depending on whether the image forming apparatus is in the first mode or in the second mode, a recording sheet can be efficiently fed so as to avoid the specific portion of the recording sheet transporting member or can be efficiently fed regardless of the specific portion.

According to another aspect of the present invention, an image forming apparatus includes an image holding member on which an image is formed, a recording sheet transporting member which has a seam and transports a recording sheet, to which an image formed on the image holding member is to be transferred, to an image transfer position while holding the recording sheet thereon, the recording sheet transporting member being endless, a seam detector which detects the seam, a recording sheet information detector which detects an information concerning the recording sheet, an image transferring member which transfers the image on the image holding member to the recording sheet at the image transfer position, and a timing decision means which decides a timing for feeding the recording sheet to the recording sheet transporting member. The recording sheet is fed to the recording sheet transporting member at a certain interval. The information includes information concerning whether or not the recording sheet causes a poor image when the recording sheet is located on the seam. The timing decided by the timing decision means is based on the information and a detected signal from the seam detector.

According to the image forming apparatus, the timing for feeding the recording sheet to the recording sheet transforming member is decided in accordance with whether or not the recording sheet is a recording medium which causes a poor image due to the seam of the recording sheet transporting member. Therefore, a recording sheet can be efficiently fed so as to avoid the seam of the recording sheet transporting member or can be efficiently fed regardless of the seam, depending on the recording sheet.

It is preferable that the timing decision member decides, based on the detected signal from the seam detector, a first timing at which the recording sheet is fed to the recording sheet transporting member at a minimum interval regardless of the detected signal from the seam detector and a second timing at which the recording sheet is fed to the recording sheet transporting member so as not to be located on the seam. This enables a quick feeding of a recording sheet which is not required to avoid the seam at the first timing.

It is preferable that the information relates to a type of the recording sheet and a length of the recording sheet in the traveling direction thereof. By the information relating to a type of the recording sheet, it becomes easy to decide whether or not the recording sheet is a recording medium which is affected by the seam.

Further, it is preferable that the recording sheet is fed to the recording sheet transporting member at the first time when the recording sheet is thick. Since a poor image will not be obtained even if the recording sheet is located on the seam when the recording sheet is thick, the feeding efficiency can be improved by feeding the recording sheet regardless of the thickness. As a thick recording sheet, an OHP film, a cardboard or a label sheet may be used.

Other objects and the features will be apparent from the following detailed description of the invention with reference to the attached drawings.

BRIEF DESCRIPTION OF THE INVENTION

The present invention will be more fully described and better understood from the following description, taken with the appended drawings, in which:

FIG. 11 is a schematic view of a recording sheet size information memory portion according to an embodiment of the present invention;

FIG. 12 is a schematic view of a recording sheet type information memory portion according to an embodiment of the present invention;

FIG. 13 is a schematic view of a setting information memory portion according to an embodiment of the present invention; and FIG. 14 is a formula information memory portion according to an embodiment of the present invention.

DETAILED DESCRIPTION OF THE PREFERRED EMBODIMENTS

Preferred embodiments of the present invention will now be described, in detail, with reference to the accompanying drawings.

Figure 1:
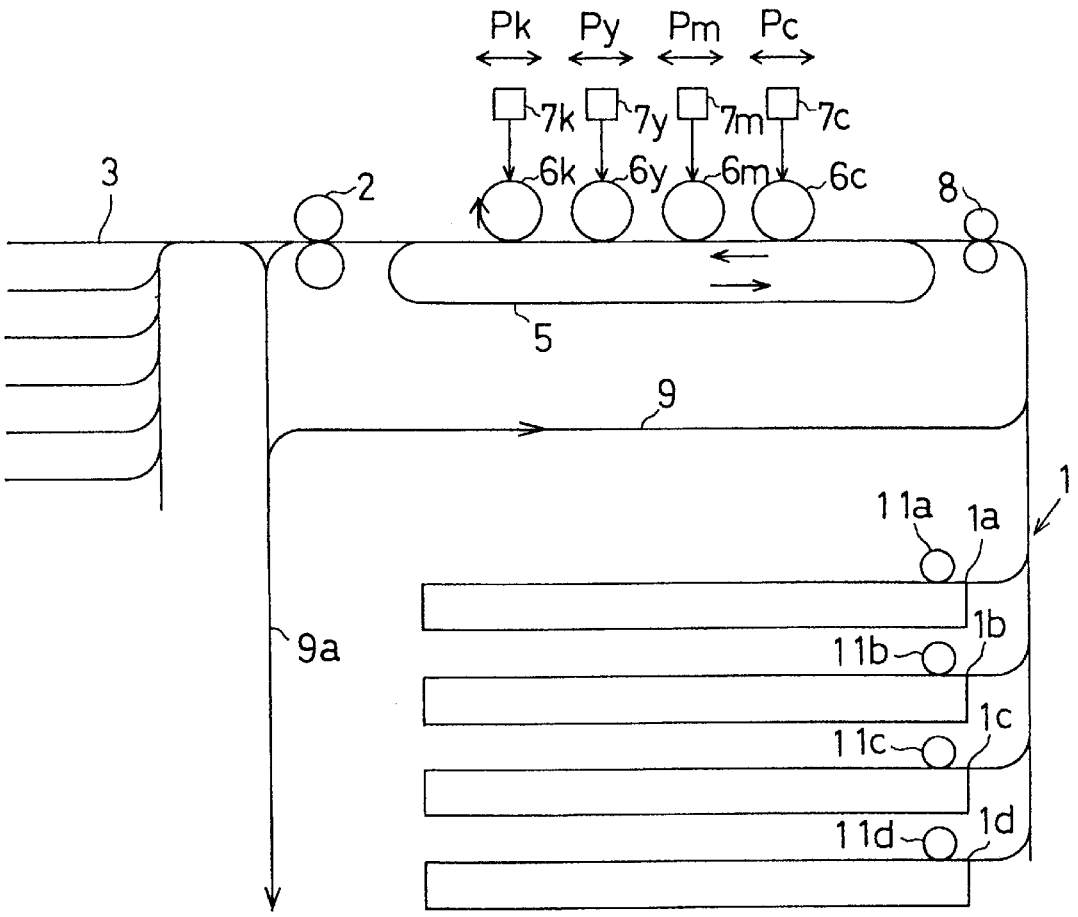
FIG. 1 is a schematic view of a major part of an image forming unit of a full color image forming apparatus according to an embodiment of the present invention.

FIG. 1 schematically shows a major part of an image forming unit of an electrophotography type full-color copying machine according to one embodiment of the present invention. The present invention can also be applied to various other types of image forming apparatus of electrophotography type, electrostatic recording type, or similar types, other than that of this embodiment.

The image forming apparatus includes four image forming units Pc, Pm, Py, Pk. Disposed below the image forming units is a paper-supply unit 1. At the left side of the image forming units, a fixing device 2 is disposed. At the left side of the fixing device 2, a sorter 3 is disposed. The sorter 3 has functions such as stapling and tray-shifting.

Between the paper-supply unit 1 and the fixing device 2, a circulation path 9 which circularly conveys a paper as a recording sheet is formed. A paper inverting unit 9*a* for inverting and transferring a paper is provided in the circulation path 9 between the fixing device 2 and the paper-supply unit 1. The paper inverting unit 9*a* also serves as a changing device which changes a paper from being introduced into the circulation path 9 for copying the reverse side of the paper into being discharged toward the sorter 3.

At the lower side of a transporting path between the paper-supply unit 1 and the fixing device 2, an endless belt 5 for holding and transporting a paper is provided such that the belt is supported and tensioned by a plurality of rollers (not shown) in a well known manner.

The belt 5 is driven in the direction of the arrows shown in FIG. 1. The belt holds and transports a paper fed from the paper-supply unit 1 to each of the image forming units Pc, Pm, Py, Pk in order.

Each of the image forming units Pc, Pm, Py, Pk, each having substantially the same construction, respectively, includes photosensitive drums 6*c*, 6*m*, 6*y*, 6*k*, each driven to rotate in the direction of the arrow shown in FIG. 1. At around each photosensitive drum, image forming elements (not shown) are disposed.

The above-mentioned image forming elements may be any desired structure. In this embodiment, an electrostatic charger for uniformly charging each photosensitive drum 6*c*, 6*m*, 6*y*, 6*k*, a developing device for developing electrostatic latent images formed on each photosensitive drum, a transferring charger for transferring a developed toner image on a paper, a cleaner for removing toner remaining on the photosensitive drum, are disposed around each photosensitive drum in order in the rotational direction thereof. Image exposing devices 7*c*, 7*m*, 7*y*, 7*k* are provided, respectively, above the photosensitive drums 6*c*, 6*m*, 6*y*, 6*k*.

In the developing devices of the image forming units Pc, Pm, Py, Pk, cyan color toner, yellow color toner, magenta color toner and black color toner are accommodated, respectively.

Each image exposing device 7*c*, 7*m*, 7*y*, 7*k* comprises a semiconductor laser, a polygon mirror, an fθ lense, etc. In the image exposing device, a laser beam, which is modulated in accordance with electric digital image signals, scans in the longitudinal direction on each photosensitive drum 6*c*, 6*m*, 6*y*, 6*k* at location between the electrostatic charger and the developing device to expose the drum surface, thereby forming an electrostatic latent image on each photosensitive drum. An image signal corresponding to a cyan color, a magenta color, a yellow color and a black color component of a color image is input into the respective image exposing device 7*c*, 7*m*, 7*y*, 7*k* of the respective image forming unit Pc, Pm, Py, Pk.

Between the image forming unit Pc and the paper-supply unit 1, a paper adhering member (not shown) is provided so that a paper fed from the paper-supply unit 1 is assuredly and electrically adhered on the belt 5. Between the image forming unit Pk and the fixing device 2, an erasing device (not shown) is provided to erase electrical charge to separate the paper adhering to the belt 5 therefrom.

The belt 5 is made of a resin film sheet having a semiconductor (or conductor) characteristic with opposite ends connected by melting, or the like, to create an endless belt. The belt 5 is endlessly driven at a constant velocity in the direction of the arrow by a driving roller (not shown). A seam of the belt 5 is regarded as an inappropriate portion for an image forming on a paper of a specific type, such as a relative thin paper, because the seam portion is different in thickness from the remaining portion, and thus exercises a harmful influence on copying an image onto such a paper from the photosensitive drums 6*c*, 6*m*, 6*y*, 6*k*. Accordingly, as will be mentioned later, when a paper is fed to the belt 5, control is required such that a paper is fed so as not to be located on the seam, or such that only a certain region of a paper is located on the seam during a special situation.

The paper-supply unit 1 comprises a plurality of paper-supply trays (for example, cassette type trays) 1*a*, 1*b*, 1*c*, 1*d* for storing different size papers, paper-supply rollers 11*a*, 11*b*, 11*c*, 11*d* each comprising a paper-supply member for supplying a paper one by one from each paper-supply tray 1*a*, 1*b*, 1*c*, 1*d*, timing rollers 8 as a feeding member for feeding a paper supplied from each paper-supply tray 1*a*, 1*b*, 1*c*, 1*d* onto the belt 5 at a certain time.

In the full color copying machine shown in FIG. 1, when a paper is transported from the timing rollers 8 onto the belt 5 while being guided by a paper transport guide (not shown), the paper is assuredly electrostatically adhered to the belt 5 as a result of the effect of the paper adhering member. With the movement of the belt 5 in the direction of the arrows shown in FIG. 1, a visible image of cyan color (C) is formed on the photosensitive drum 6*c* of the image forming unit Pc, a visible image of magenta color (M) is formed on the photosensitive drum 6*m* of the image forming unit Pm, a visible image of yellow color (Y) is formed on the photosensitive drum 6*y* of the image forming unit Py, and a visible image of black color (K) is formed on the photosensitive drum 6*k* of the image forming unit Pk, each visible image being formed separately. These visible images are transferred, one on another, onto a paper by the transferring charger of each image forming unit Pc, Pm, Py, Pk, in that order, when the paper passes under the photosensitive drum 6*c*, 6*m*, 6*y*, 6*k* of each image forming unit Pc, Pm, Py, Pk, in that order, toward the fixing device 2, in accordance with the movement of the belt 5, resulting in a composite color image. After the paper has passed the image forming unit Pk, the charged electricity of the paper is removed by the erasing device. Then the paper is detached from the belt 5. The paper detached from the belt 5 is discharged to the sorter 3 after the transferred multiple composite images are fixed by the fixing device 2.

In a case where the reverse side of the paper also is to be copied or printed for a two-sided copy, the paper is inverted at the paper inverting unit 9*a* without discharging to the sorter 3 and then transported to the circulation path 9. An image forming onto the reverse side of the paper is performed in the same way as mentioned above, and then the paper is discharged to the sorter 3. Thus, one series of a copying cycle is completed.

Figure 2:
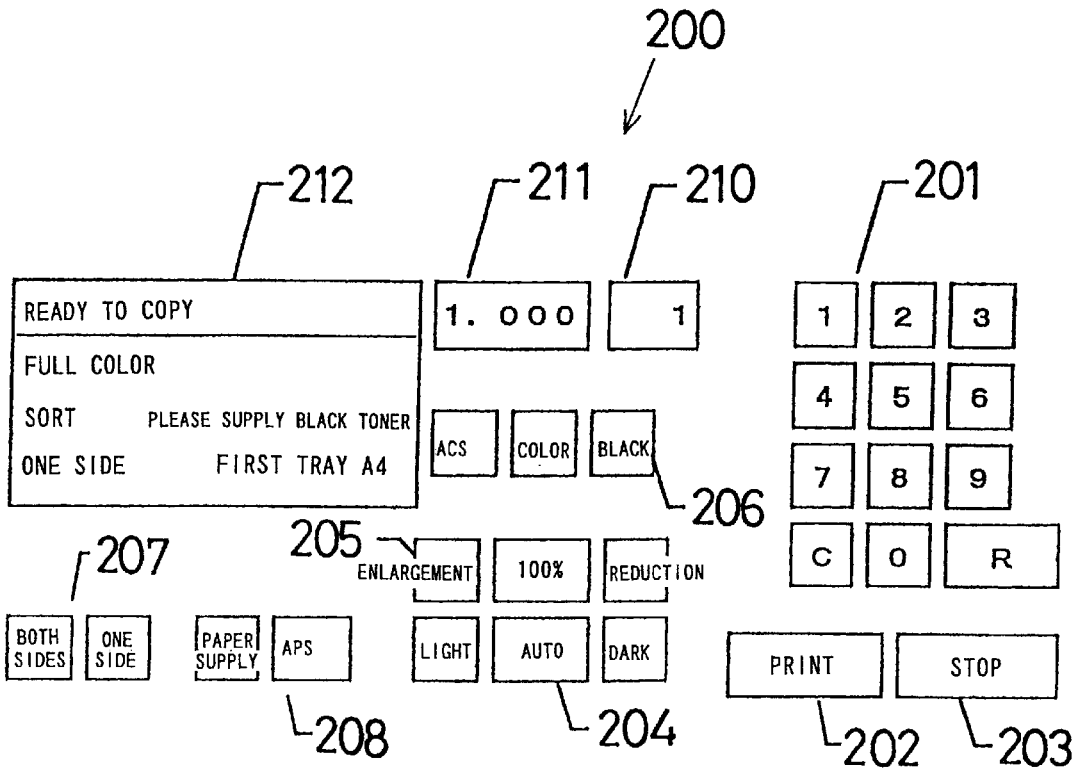
FIG. 2 is a plan view showing a portion of an operation panel according to an embodiment of the present invention.

FIG. 2 shows a part of the operation panel 200 of the full color copying machine shown in FIG. 1. This operation panel 200 enables the user to select a certain copy mode from various copy modes, start copying and recognize the set copy mode and the condition of the apparatus from the display.

A copy number setting portion 201 includes a plurality of keys for setting number of copies to be made and clearing the set number.

A key 202 marked as 'PRINT' is used to start copying. A key marked as 'STOP' is used to stop a copying operation. Darkness setting keys 204 are used to adjust the darkness of the image to be copied. Reduce/enlarge rate setting keys 205 are used to set a reduce/enlarge rate of the image to be copied. Color mode selecting keys 206 are used to set whether the image to be copied is printed in full color or only in black.

Copy side selection keys 207 are used to set whether the image to be copied is printed on one side of a paper or on both sides thereof. Tray select keys 208 are used to select one of four paper-supply trays.

A copy number display portion 210 displays number of copies to be made before the copy operation and number of remaining copies during the copy operation. A reduce/enlarge rate display portion 211 displays the set rate. A liquid crystal display portion 212 is a multi-purpose display portion which displays the set copy mode, the status of the apparatus and various information other than the information of the number of papers or the reduce/enlarge rate.

Figure 3:
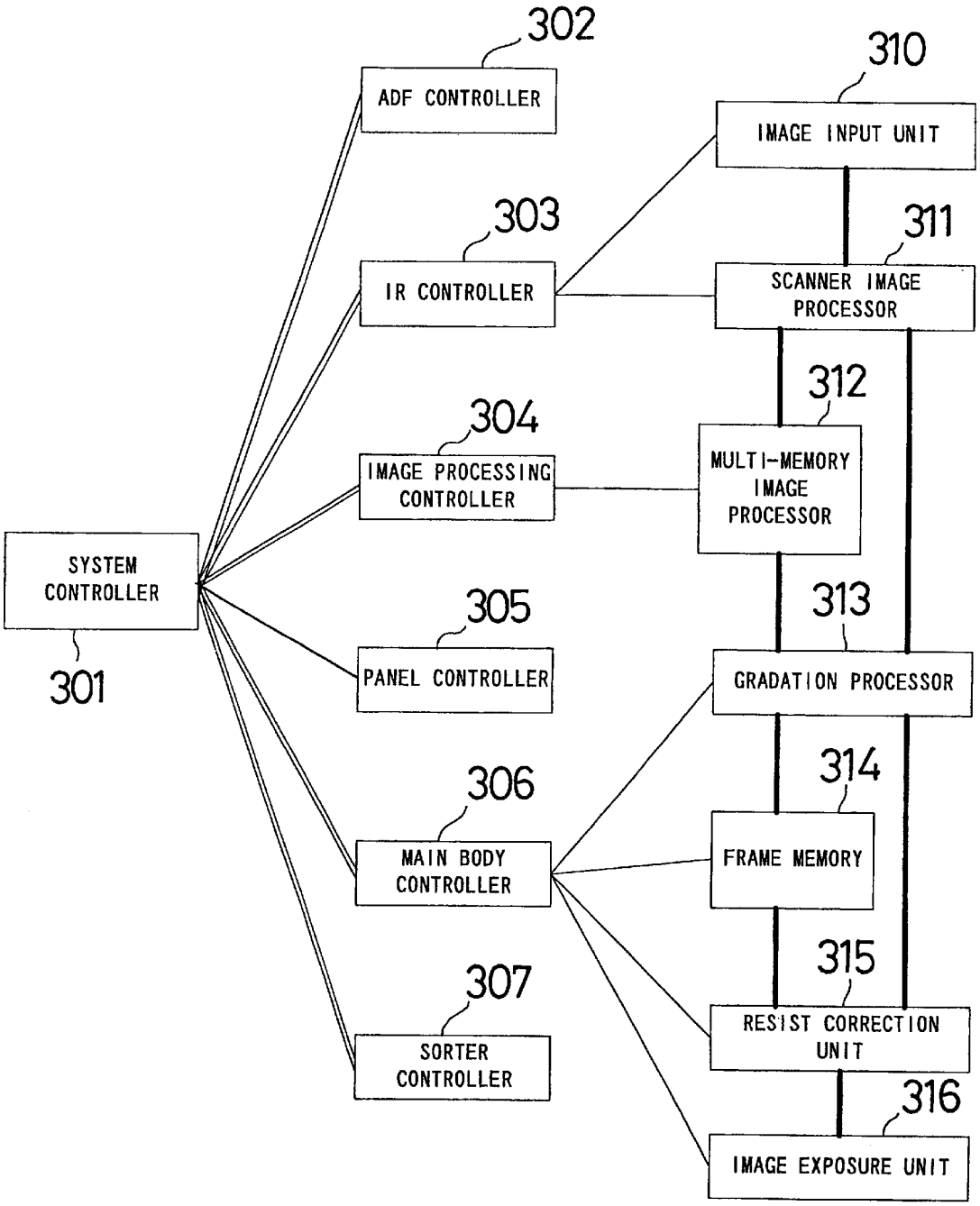
FIG. 3 is a block diagram showing a control of the whole apparatus according to an embodiment of the present invention.

FIG. 3 is a block diagram showing an overall control of a full color copying machine, such as the one shown in FIGS. 1 and 2.

The full color copying machine includes an image reader (IR) for reading an image information of a document as a function of a copying machine, an automatic document feeder (ADF) for automatically feeding a document one by one to an image reading portion of the image reader, in addition to the image forming main portion and the panel portion described in detail with FIGS. 1 and 2. However, the construction of the machine is not limited to the above.

A system controller 301 is a control portion which controls the whole copying machine.

An ADF controller 302 is a control portion which controls the automatic document feeder such that documents are fed one by one to the image reading portion of the image reader and are discharged to a document discharge portion after the completion of the reading of the images.

An IR controller 303 is a control portion for controlling the scanning velocity and position of a scanner for reading an image of a document.

An image processing controller 304 is a control portion which operates a multi-memory image processor 312 depending on a copy sequence or a copy mode. Concretely, the image forming processing controller 304 controls the recording of an image signal processed by a scanner image processor 311 for every one page of the documents. Further, the image processor controller 304 controls the selecting of an image signal of the document stored for every one page in the order depending on a copy sequence, etc. and the sending of the stored image signal to a gradation processor 313. Furthermore, the image processing controller 304 controls a rotation of an image by 90 degrees or 180 degrees depending on a copy mode, etc.

A panel controller 305 is a control portion which processes and displays key inputs of the operation panel 200 as described with FIG. 2.

A main body controller 306 is a control portion which controls the transportation of papers, the belt 5, the photosensitive drums 6*c*, 6*m*, 6*y*, 6*k*, the image forming elements disposed around the drums, the fixing device 2, etc., described in connection with FIG. 1. A more detailed explanation will be given later.

A sorter controller 307 is a control portion which controls the discharge of the papers in the sorter 3, the movement of bins, the position of the shift tray and the stapling operation.

An image input unit 310 includes a sensor comprising CCD and the like for reading an image of a document, a circuit which digitalizes the signal from the sensor. In this embodiment, each component of the color image C, M, Y and K is processed at the same time.

The scanner image processor 311 includes a circuit for reducing/enlarging, shifting, erasing the digitalized image signal depending on a copy mode, etc.

The multi-memory image processor 312 includes a memory for storing image information and a circuit for rotating or reducing/enlarging an image.

The gradation processor 313 includes a circuit which converts the tone data, for example, from eight tones to three tones, corresponding to a circuit.

A frame memory 314 includes a circuit which temporarily saves image signals of a plurality of pages when copying both sides and outputs an image signal of a required page at a required time.

A resist correction unit 315 includes a circuit which delays the image signals corresponding to each C, M, Y and K composition of the color image by a time corresponding to a timing gap of the paper passing below the image forming units Pc, Pm, Py, Pk in the order. By this circuit, the image signal of each C, M, Y and K component can be processed at the same time between the image input unit 310 and the gradation processor 313 or the frame memory 314.

The image exposure unit 316 corresponds to the reference numerals 7*c*, 7*m*, 7*y*, 7*k* shown in FIG. 1, and comprises a circuit which forms an electrostatic latent image of each C, M, Y and K component on the respective photosensitive drums 6*c*, 6*m*, 6*y*, 6*k* in response to a corresponding image signal.

A paper-feed timing for feeding the paper on the image-transfer belt (referred to simply as the belt) will be described as follows.

In this embodiment, a first timing at which the recording sheet is fed to the belt 5 at a minimum interval regardless of the seam or a second timing at which the recording sheet is fed to the belt so as not to be located on the seam is decided, in accordance with the paper information.

Since the first timing at which the recording sheet is fed to the belt at a minimum interval does not depend on the seam of the belt 5 and the construction for deciding the first timing is well known in a conventional image forming apparatus, such explanation will be omitted.

Now, a timing control of the feeding of the paper to the belt 5 so as to avoid the seam will be described.

Figure 4:
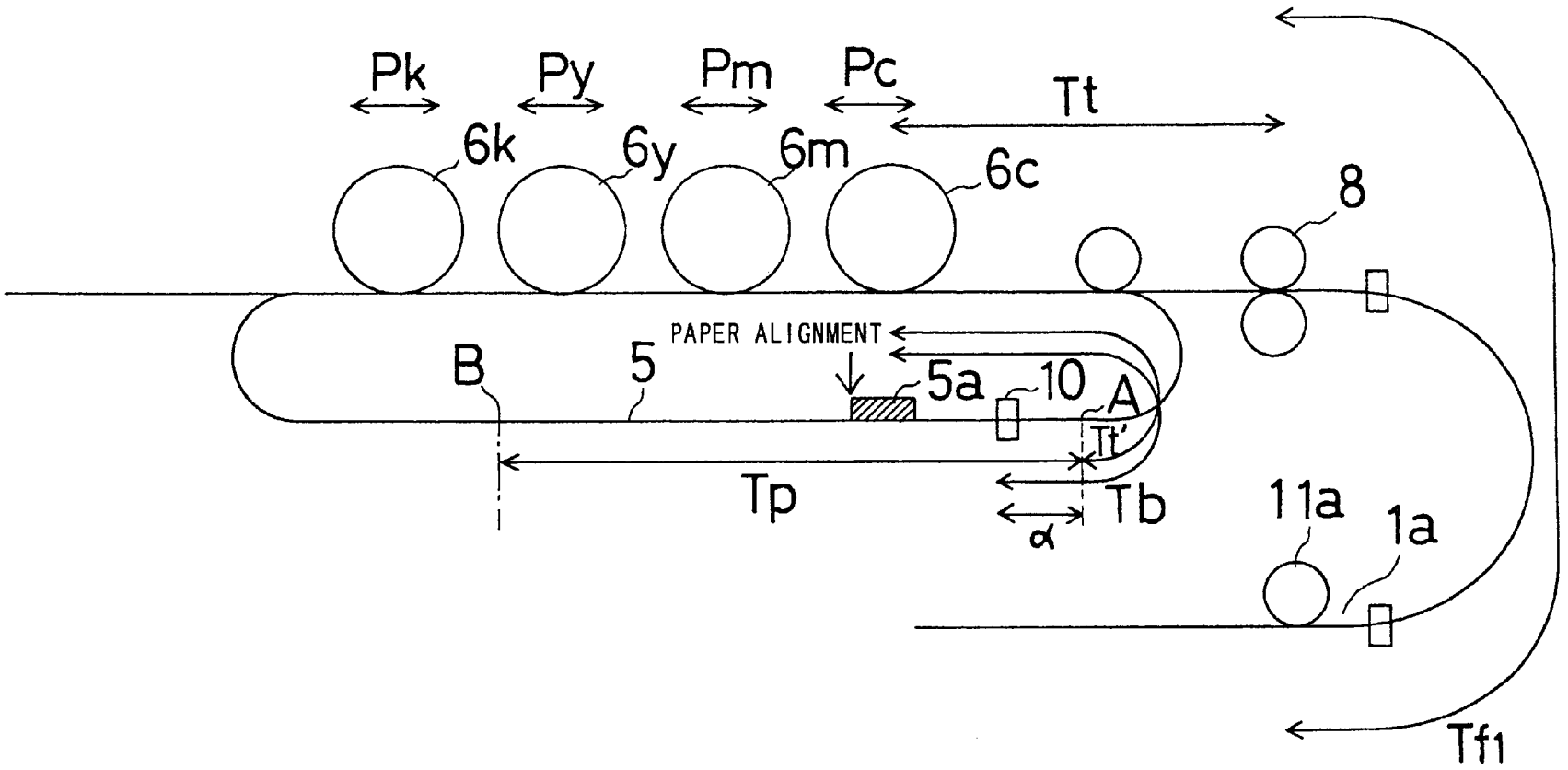
FIG. 4 is a schematic view of timing rollers, a image-forming belt and therearound according to an embodiment of the present invention.
Figure 5:
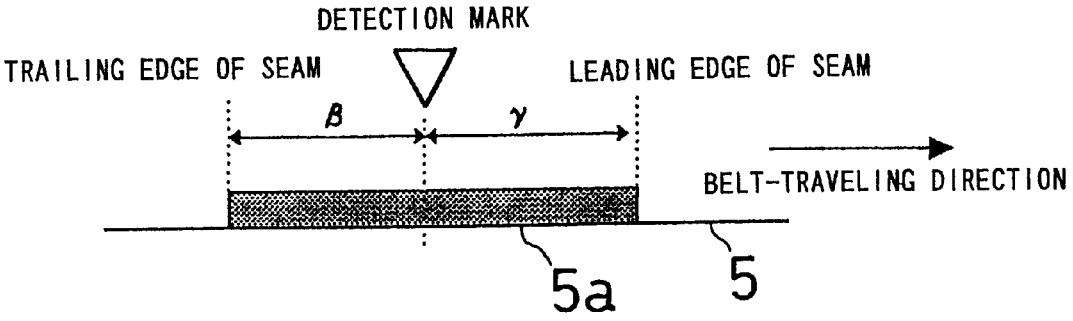
FIG. 5 is an explanatory view showing a seam portion of the belt according to an embodiment of the present invention.

FIG. 4 illustrates the structure around the timing rollers 8 and the belt 5. As shown in FIG. 4, a seam detection sensor 10 for detecting the seam 5*a* of the belt 5 is positioned on the upper stream of the photosensitive drum 6*c* along the traveling direction of the belt 5. When the seam detection sensor 10 detects the seam 5*a*, it generates an image-data request signal, which is supplied to the image processing circuit. If the time required for transporting the paper from the timing rollers 8 to the photosensitive drum 6*c*, which is located in the first image forming unit PC, is Tt, and if the time from the generation of the image-data request signal to the actual start of paper-feeding by the timing rollers 8 plus extra time is $\alpha$, then the seam detection sensor 10 is placed at a position defined by time Tb which is sum of Tt' and a ($Tb=Tt'+\alpha$), where $Tt'=Tt$.

Accordingly, if time a has passed since the detection of the seam 5*a* by the seam detection sensor 10, (that is, if the seam 5*a* has reached point A shown in FIG. 4), the timing rollers 8 are driven to feed the paper onto the image-transfer belt 5, whereby the leading edge of the paper is aligned with the seam 5*a*. It should be assumed that the width of the seam 5*a* of the belt is infinitesimally small, and that the position of the seam 5*a* is coincident with the reference position for the leading edge of the paper.

If the time defined by (length of the paper)/(system speed) is Tp, and if the point at the upper stream from point A by time Tp is point B, then the paper-feed from the timing rollers 8 to the belt 5 is performed only when the seam 5*a* of the belt 5 does not exist in the section from B to A. Thus, point A corresponds to a time at which the leading edge of the paper aligns with the seam 5*a*, while point B corresponds to a time at which the trailing edge of the paper aligns with the seam 5*a*. If the paper is fed to the belt 5 with the seam 5*a* located in the section from point B to point A, the paper will be positioned on the seam 5*a*.

If the time elapsed from the detection of the seam 5*a* by the seam detection sensor 10 is T, T must satisfies formula (1) in order for the seam 5*a* not to exist in the section from point B to A (i.e., in order for the seam 5*a* to be located in the section from point A to B):

$$\alpha<T<Ts-Tp+\alpha \quad (1)$$

where Ts is the time required for one revolution of the belt 5, and the range of T is from 0 to Ts.

In actual process, the seam 5*a* has a certain width, and this width is converted to time W, which is defined as $W=\beta+\gamma$, where $\gamma$ represents time required for the paper to move from the detection mark to the leading edge of the seam 5*a*, and $\beta$ is time required for the paper to move from the trailing edge of the seam 5*a* to the detection mark. $\beta$ and $\gamma$ are determined so that the resultant image is not affected by the seam 5*a*.

Taking $\beta$ and $\gamma$ into account, inequality (1) becomes $$\alpha+\beta<T<Ts-(Tp+\gamma)+\alpha \quad (2)$$

which is further rewritten as $$0<T-(\alpha+\beta)<Ts-Tp-W \quad (3)$$

Figure 6:
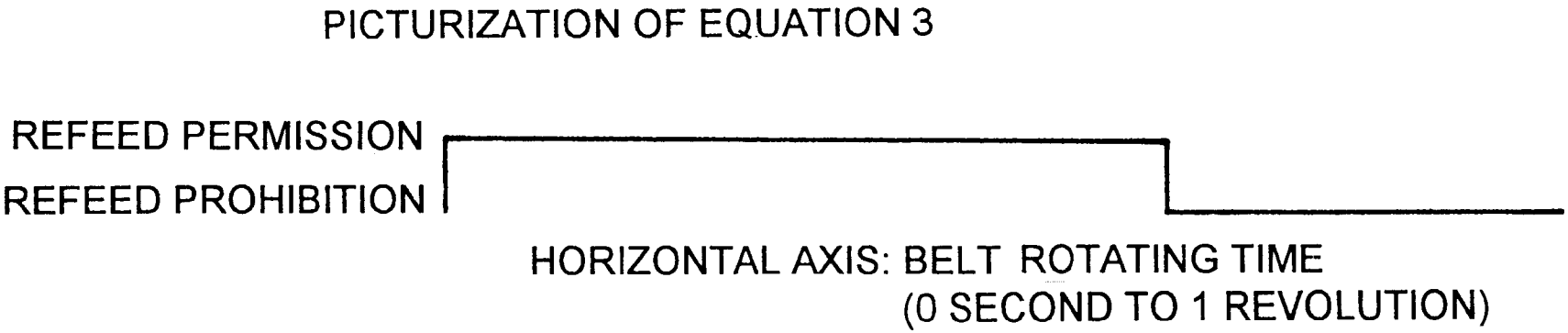
FIG. 6 is a graphical view showing the formula 3.

If the paper is fed from the timing rollers 8 when T satisfies inequality (2) or (3), the paper does not overlap the seam 5*a*. Therefore, the paper-feed timing is controlled so that the paper is fed onto the belt 5 from the timing rollers 8 only when T satisfies inequality (2) or (3). Inequality (3) is picturized in FIG. 6.

The above is the basic explanation for the paper-feed control operation for avoiding the paper positioned on the seam 6*a* of the belt 5. However, in the actual operation, other factors should be considered.

In order to maintain the quick imaging efficiency, the position of the seam detection sensor 10 is determined so as to satisfy $$Tt+\alpha<Tb<Tf1$$

where Tf1 is time required from the initial paper supply to the formation of the loop. The image-transfer belt 5 is controlled such that the seam 5*a* is located at the position satisfy $Ts-T<Tf1$ when the belt 5 stops. Then, the belt 5 is driven again to feed the next paper immediately after the previous paper passed through the seam 5*a*. (That is, the belt 5 is driven again when $Tf1-(Ts-T)$ has elapsed since the start of the paper feed.)

In order to achieve these control operations, the belt 5 should be driven at a constant speed for time T.

If the seam 5*a* of the belt 5 appears earlier than the expected time, due to, for example, delay in paper transportation or fluctuation in the belt stop position, then, it is preferable that the belt 5 is rotated one more revolution without feeding the next paper if in the fast imaging mode.

If the sorter has troubles in continuously ejecting papers due to, for example, a temperature change in image fixation, it is preferable that this information is added to the paper-feed timing control operation. In this case, the interval between papers positioned on the belt 5 is increased.

In general, the paper-transport speed can be changed according to the types of papers (e.g., ordinary paper, OHP film, thick paper, etc.). It is also preferable to control and adjust the interval of papers according to the change in the paper-transport speed.

In order to avoid an image-memory phenomenon, in which a latent image formed on the photosensitive drum remains as an electrostatic image on the photosensitive drum and adversely affects the next image forming process, it is preferable to leave a space between papers by a distance corresponding to one revolution of the photosensitive drums 6*c*, 6*m*, 6*y*, and 6*k*. It is also preferable to set the paper ejection interval greater than a predetermined value when ejecting small-sized paper to the sorter. To prevent the image-memory phenomenon, a series of steps including charging, exposure, and erasing are performed over one revolution of the photosensitive drum.

An effective paper feeding can be performed by selecting the timing at which the paper is fed so as to avoid the seam or the timing at which the paper is fed regardless of the seam, based on the information concerning the paper. This can improve the productivity. For example, in a case where the paper is, for example, an OHP film or cardboard, since it is thought that such paper is seldom affected by the seam and therefore a poor image-transferring due to the seam seldom occurs, the productivity can be improved by feeding the paper regardless of the seam.

Further, more improved paper-feed efficiency can be obtained by using three or more paper-feed timings.

Figure 7:
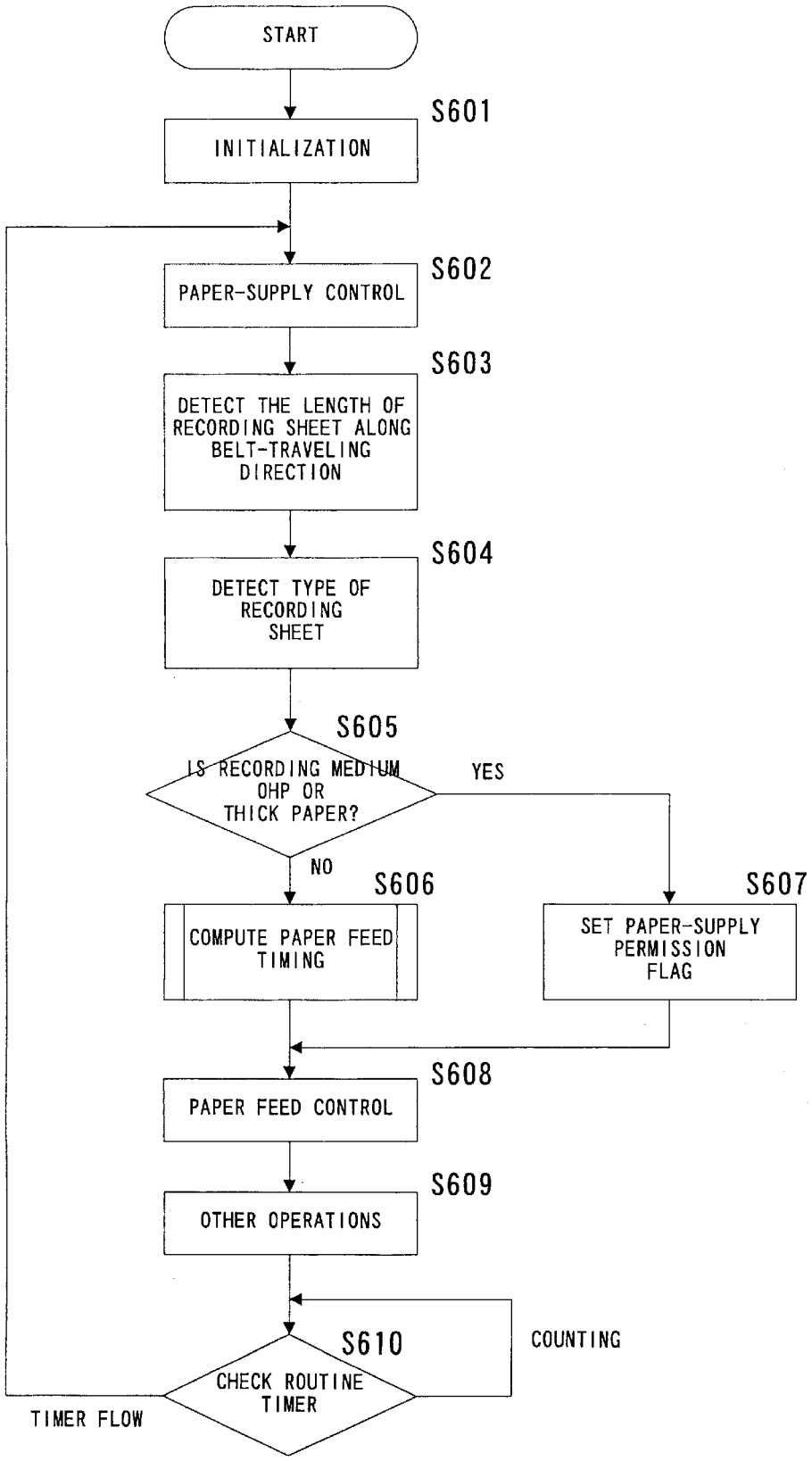
FIG. 7 is a flowchart showing a main routine process according to an embodiment of the present invention.

FIG. 7 shows a flowchart of a processing by the main controller 306.

When a power source is turned on and a CPU of the main body controller 306 starts operating, a predetermined initialization processing is performed (Step S601) In the initialization processing, the CPU, a memory or an I/O, etc. are initialized. Data are also stored in α, β, γ and Ts elements of the setting information storing portion shown in FIG. 13. Each processing (Steps S602–S610) is performed once at a certain time.

At the next step (S602), a paper-supply processing is performed. In the paper-supply processing, a paper is supplied by a semicircular roller, etc. from the selected paper outlet and is transferred to the timing rollers 8 to form a loop. Note, the paper-supply processing is not limited to the above example.

At step S603, a length of the paper along the traveling direction is detected. The length Tp of the paper along the traveling direction is calculated by multiplying a paper passing time by a system speed, wherein the paper passing time is detected by, for example, a sensor. In a case where the selected paper outlet is a cassette type tray, the length of the paper along the traveling direction can be calculated based on the position of a paper stopping plate provided in the cassette type tray. Alternatively, such a length may be set by the user. Though any method of detecting the length of the paper may be used, it is enough that the length of the paper along the traveling direction is detected and stored in a paper (recording sheet) size information portion shown in FIG. 11.

At step S604, the type of the paper is detected. For example, information on a type of paper selected by the user may be detected, or the penetration type sensor may be disposed on a paper transfer path to detect that the paper is an OHP film based on the amount of light passed through the paper. Though any method of detecting the type of the paper may be used, it is enough that the type of the paper is detected and stored in a paper (recording sheet) type information portion shown in FIG. 12.

At step S605, if the data stored in the paper type information indicates a thick paper such as an OHP film, a thick paper or a label paper (Yes), the paper-supply permission flag is allowed (step S607), and a paper-feed processing (step S608) is performed. Otherwise (step S605 resulting in NO), a paper-feed timing calculation processing (step S606) is performed.

At step S609, other processes are performed. The other processes include processes of a communication with a separate CPU, a process concerning an unusual detect, a process concerning an input or output from an I/O port, a control of an image forming process, and a process of an image forming apparatus. These processes do not directly relate to this embodiment of the present invention.

A routine timer (at step S610) is a timer by which processes from the paper-supply process (S602) through the other process (S609) are performed every predetermined time. Each time the timer flows, each process is carried out once.

Figure 8:
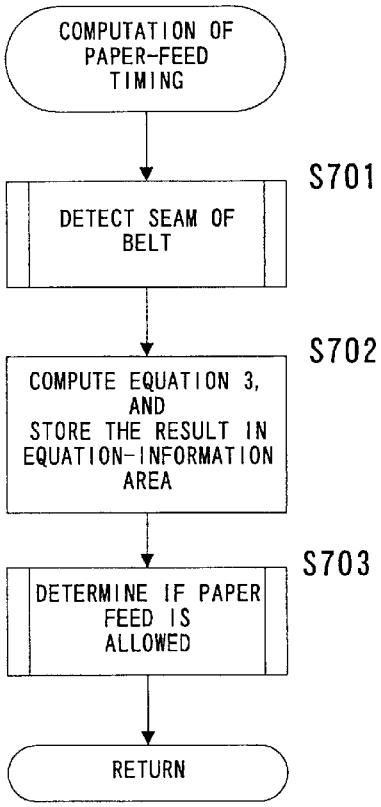
FIG. 8 is a flowchart showing a paper feed timing calculation process according to an embodiment of the present invention.

Next, referring to FIG. 8, the paper-feed timing calculate process of step S606 will be explained.

At step S701, a seam detect process is performed. At step S702, α, β, γ, Ts are read from the setting information in FIG. 13, and Tp is read from the paper (recording sheet) size information portion. These date are calculated by the formula (3) and the results are stored in the formula information portion shown in FIG. 14. After that, a paper-feed decision process is performed at step S703.

Figure 9:
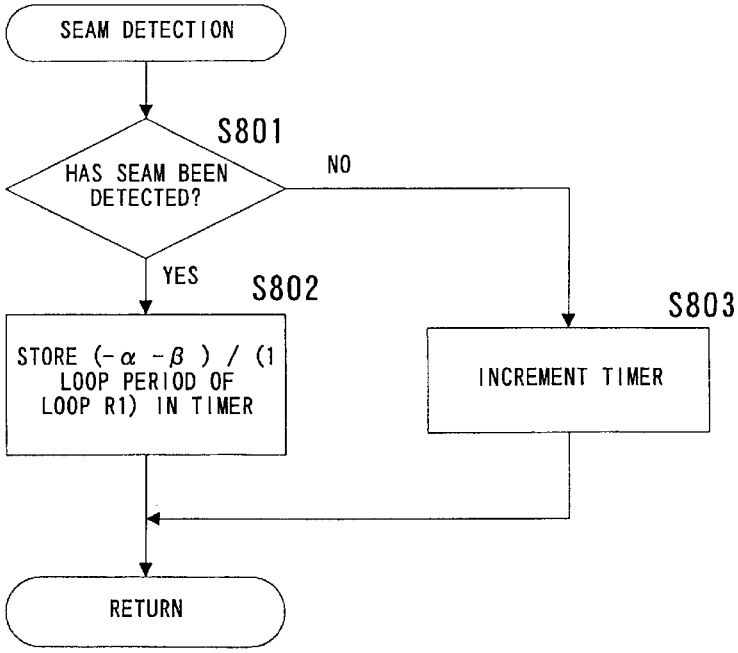
FIG. 9 is a flowchart showing a seam detection process according to an embodiment of the present invention.

Referring to FIG. 9, the seam detect process of step S701 at the paper-feed timing calculate process will be explained.

At step S801, for example, a seam detect sensor 10 including t5 a combination of LED and phototransistors, or the like, detects the seam. At step S802, (-α-β)/(one loop time of the main routine) are stored in a timer which counts the time passed after detecting the seam. In the case where the seam has been not detected, the timer is incremented at step S803.

Figure 10:
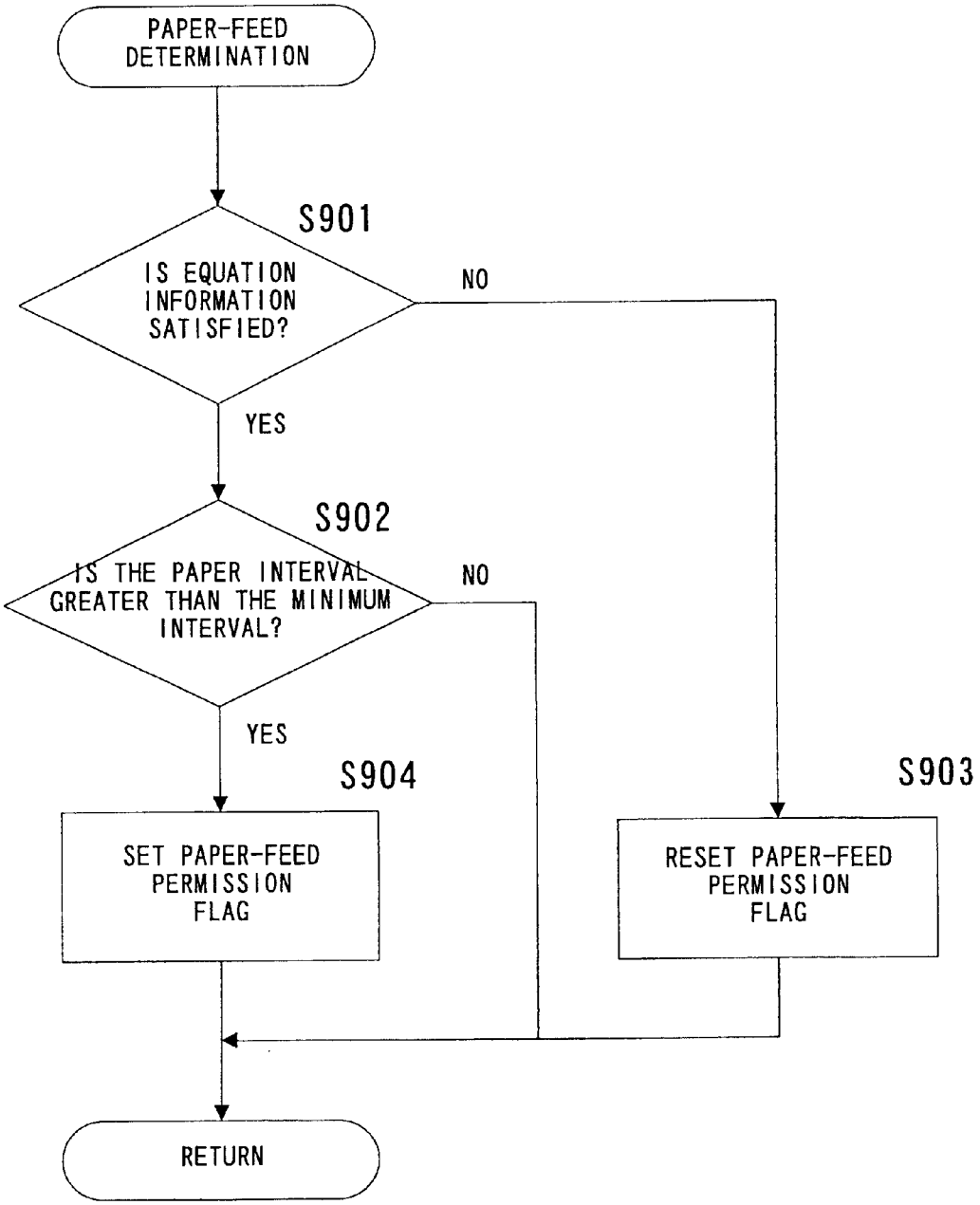
FIG. 10 is a flow chart showing a paper feed decision process according to an embodiment of the present invention.

Referring to FIG. 10, the paper feed decision process (step S703) in the paper feed timing calculate process shown in FIG. 8 will be described.

At step S901, it is judged whether or not (the time in the timer×the one loop time of loop R1) satisfies the data stored in the formula information (formula (3)). If it does not satisfy the formula (NO), the paper-feed permission flag is reset at step S903. If it satisfies the formula, at step S902, it is judged whether or not the interval between the present paper and a paper ahead thereof is greater than the minimum interval. If the interval is greater than the minimum interval, the paper-feed permission flag is set at step S904. If the interval is not greater, nothing is done. When a paper is fed initially, the paper-feed permission flag is set without any judging as in step S902, or the interval is judged to be greater than the minimum interval. The paper-feed permission flag is a flag which is used to judge whether or not a paper can be fed in the paper-feed process.

In the paper transport process shown in FIG. 7 at step S608, the paper transported from the paper supply portion is made to stop, and a skew correction and a timing adjustment are done. In the timing adjustment, if the paper-feed permission flag is set, a paper is fed onto the transporting belt.

In summary, at steps S603 and S604, information concerning the paper is detected. Then, at step S605, a paper-feed timing is judged based on the detected paper information. In a case where a paper is allowed to be located on the seam, the paper feed process of the step at S608 is performed. In a case where a paper is not allowed to be located on the seam, the paper feed timing is calculated by the paper feed timing calculate process at step S606. Depending on the result, the paper feed permission flag is set to allow or reset not to allow feeding the paper on to the transporting belt.

Thereafter, the paper feed process is performed at step S608. In the paper feed process, the state of the paper-feed permission flag is judged. When the flag is set, the paper transported to the timing rollers 8 is fed to the transporting belt. On the other hand, when the flag is not set, the paper is prohibited from being transported to the transporting belt. Thus, a paper is fed so as to avoid the seam.

In the above-mentioned embodiment, though a seam is explained as one example of a portion which is inappropriate for forming an image on a specific type of paper held on the belt, there may exist an inappropriate portion other than a seam. The invention can also be applied in such a case.

According to the present invention, a recording sheet can be fed to the recording sheet transporting member so as to avoid a seam or can be fed to the recording transporting member regardless of the seam, depending on the type of the recording sheet. Therefore, when a recording sheet is a recording medium which does not result in a poor image even if the recording sheet is located on a seam, such as an OHP film, a thick paper or a label paper, the recording sheet can be fed at the minimum recording sheet interval. On the other hand, in a case where a recording sheet is a recording medium which may cause a poor image, the recording sheet can be fed so as not to be located on the seam. As a result, paper feeding efficiency of paper which does not result in a poor image even if the recording sheet is located on a seam can be improved, which in turn improves the productivity as a whole.

If the information relates to a type of the recording sheet and a length of the recording sheet along the traveling direction, it is easy to judge whether or not the recording sheet is a recording medium which causes a poor image based on the information of the type of the recording sheet and also is easy to control the feed of the recording sheet so as to avoid the seam based on the information of the length of the recording sheet.

This application claims priority to Japanese Patent Application No. H9(1997)-321792 filed on Nov. 21, 1997, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An image forming apparatus, comprising:

a recording sheet transporting member which has a specific portion and transports a recording sheet while holding the recording sheet thereon, said recording sheet transporting member being endless;

a recording sheet feeding member which feeds the recording sheet to said recording sheet transporting member; and a controller which controls at least one of said recording sheet transporting member and said recording sheet feeding member so that the recording sheet is fed to said recording sheet transporting member so as not to be located on said specific portion in a case where said image forming apparatus is in a first mode, and so that the recording sheet is fed to said recording sheet transporting member regardless of said specific portion in a case where said image forming apparatus is in a second mode, wherein said controller selectively sets said image forming apparatus in the first mode or in the second mode in accordance with data regarding a characteristic of the recording sheet.

2. The image forming apparatus as recited in claim 1, wherein the data relates to a length of the recording sheet.

3. The image forming apparatus as recited in claim 1, wherein the data relates to a thickness of the recording sheet.

4. The image forming apparatus as recited in claim 1, wherein the data relates to a type of the recording sheet.

5. The image forming apparatus as recited in claim 1, further comprising a detector which detects said specific portion, wherein said controller controls, based on a detected result of said detector, at least one of said recording sheet transporting member and said recording sheet feeding member when said image forming apparatus is in the first mode.

6. The image forming apparatus as recited in claim 1, wherein said controller controls said recording sheet feeding member.

7. The image forming apparatus as recited in claim 1, wherein said specific portion is a seam.

8. An image forming apparatus, comprising:

an image holding member on which an image is formed;

a recording sheet transporting member which has a seam and transports a recording sheet, to which an image formed on said image holding member is to be transferred, to an image transfer position while holding the recording sheet thereon, said recording sheet transporting member being endless;

a seam detector which detects said seam;

a recording sheet information detector which detects information concerning the recording sheet;

an image transferring member which transfers the image on said image holding member to the recording sheet at the image transfer position; and a timing decision means which decides a timing for feeding the recording sheet to said recording sheet transporting member, wherein the recording sheet is fed to said recording sheet transporting member at a certain interval, wherein the information includes information concerning whether or not the recording sheet causes a poor image when the recording sheet is located on said seam, and wherein the timing decided by said timing decision means is based on the information and a detected signal from said seam detector.

9. The image forming apparatus as recited in claim 8, wherein said timing decision means decides, based on the detected signal from said seam detector, a first timing at which the recording sheet is fed to said recording sheet transporting member at a minimum interval regardless of the detected signal from said seam detector and a second timing at which the recording sheet is fed to said recording sheet transporting member so as not to be located on said seam.

10. The image forming apparatus as recited in claim 8, wherein the information relates to a type of the recording sheet and a length of the recording sheet in a traveling direction thereof.

11. The image forming apparatus as recited in claim 9, wherein the information relates to a type of the recording sheet and a length of the recording sheet in a traveling direction thereof.

12. The image forming apparatus as recited in claim 10, wherein the recording sheet is fed to said recording sheet transporting member at the first timing when a recording sheet is thick.

13. The image forming apparatus as recited in claim 11, wherein the recording sheet is fed to said recording sheet transporting member at the first timing when the recording sheet is thick.

14. An image forming apparatus comprising:

a transporting member which transports a recording sheet while holding the recording sheet;

a feeding unit which accommodates a first recording sheet and a second recording sheet, said feeding unit capable of feeding one of said first recording sheet and said second recording sheet at one time, said transporting member having an inappropriate portion not suitable for forming an image on the first recording sheet;

a controller which selectively executes one of a first control and a second control, said first control being for controlling said feeding unit to feed said first recording sheet and for controlling at least one of said feeding unit and said transporting member so that said first recording sheet is fed to said transporting member with avoiding an interference with said inappropriate portion, said second control being for controlling said feeding unit to feed said second recording sheet and for controlling at least one of said feeding unit and said transporting member so that said second recording sheet is fed to said transporting member regardless of said inappropriate portion.

15. The image forming apparatus as recited in claim 14, further comprising:

a selector which selects one of said first recording sheet and said second recording sheet, wherein said controller selectively executes one of said first control and said second control based on the selected result of said selector.

16. The image forming apparatus as recited in claim 15, wherein a user selects one of said first recording sheet and said second recording sheet by operating said selector.

17. The image forming apparatus as recited in claim 14, wherein said first recording sheet is different in thickness from said second recording sheet.

18. The image forming apparatus as recited in claim 14, wherein said first recording sheet is different in length from said second recording sheet.

19. The image forming apparatus as recited in claim 14, wherein said first recording sheet is different in type from said second recording sheet.

20. The image forming apparatus as recited in claim 14, wherein said inappropriate portion is a seam.

* * * * *